US007584728B2

(12) United States Patent
Berndorfer

(10) Patent No.: US 7,584,728 B2
(45) Date of Patent: Sep. 8, 2009

(54) METHOD AND APPARATUS FOR OPERATING AN OIL FLOW CONTROL VALVE

(75) Inventor: Axel H. Berndorfer, Nittel (DE)

(73) Assignee: Delphi Technologies, Inc., Troy, MI (US)

( * ) Notice: Subject to any disclaimer, the term of this patent is extended or adjusted under 35 U.S.C. 154(b) by 168 days.

(21) Appl. No.: 11/643,037

(22) Filed: Dec. 20, 2006

(65) Prior Publication Data

US 2007/0175425 A1 Aug. 2, 2007

(30) Foreign Application Priority Data

Dec. 23, 2005 (EP) ..... 05028306

(51) Int. Cl.
*F01L 1/34* (2006.01)

(52) U.S. Cl. ..... 123/90.15; 123/90.17; 137/625.69; 464/160

(58) Field of Classification Search ..... 123/90.15, 123/90.16, 90.17, 90.18, 90.12, 90.13; 464/1, 464/2, 160; 137/511, 625, 625.69
See application file for complete search history.

(56) References Cited

U.S. PATENT DOCUMENTS 5,184,578 A * 2/1993 Quinn et al. ..... 123/90.17
5,611,304 A * 3/1997 Shinojima ..... 123/90.15
6,883,475 B2 * 4/2005 Simpson ..... 123/90.15

OTHER PUBLICATIONS

Simpson, Phase Mounted DPCS (differential Pressure Control system) to Reduce Axial Length of the Engine, US Patent Application Publication, Pub. No. US 2003/0196616 A1, Oct. 23, 2003.*

* cited by examiner

*Primary Examiner*—Ching Chang
(74) *Attorney, Agent, or Firm*—Patrick M. Griffin

(57) ABSTRACT

An oil flow control valve (10) in a combustion engine is operated for affecting a cam phaser (26) disposed at an output side of said oil flow control valve (10). The cam phaser includes a spool (14) disposed in a spool housing (12). The method for operating the valve includes synchronising a displacement of said spool (14) in said housing (12) with combustion demands, and synchronising movement of said spool (14) with oil pressure characteristics on the output side of the oil flow control valve (10).

6 Claims, 6 Drawing Sheets

METHOD AND APPARATUS FOR OPERATING AN OIL FLOW CONTROL VALVE

FIELD OF THE INVENTION

The present invention generally relates to an oil flow control valve for a cam phaser. The invention more particularly relates to a method and a corresponding apparatus for operating and/or controlling said oil flow control valve.

BACKGROUND OF THE INVENTION

Cam phasers, as is known in the art, are used to control the angular relationship of a pulley or sprocket to a camshaft of a combustion engine. A variable cam phaser (VCP) allows changing the phase relationship while the engine is running. Typically, a VCP is used to shift an intake cam on a dual overhead cam engine in order to broaden the torque curve of the engine, to increase peak power at high revolution speeds, and to improve the idle quality. Also, an exhaust cam can be shifted by a cam phaser in order to provide internal charge diluent control, which can significantly reduce HC and NOx emissions, or to improve fuel economy. The above objectives are in the following briefly termed as combustion demands. With this definition a VCP is used to account for combustion demands.

Cam phasers are controlled by hydraulic systems, which use pressurised lubrication oil from the engine in order to change the relative position between camshaft and crankshaft, thus altering the valve timing. An "advance" or "retard" position of the camshaft is commanded via an oil flow control valve (in the following briefly termed "OCV"). The OCV controls the oil flow to different ports entering a VCP, thus controlling the angular position of the camshaft relative to pulley or sprocket. However, the efforts in the valve train pressurise the oil contained in the chambers of the VCP such that the oil pressure inside the VCP reaches peaks, which can be higher than the oil control supply pressure, i.e., the oil pressure supplied by the engine. This can lead to a certain amount of reverse oil flow across the OCV, diminishing the phase rate performance of the cam phasing system.

To avoid the reverse oil flow under the above mentioned circumstances, recent approaches have proposed to employ a check valve, integrated in the oil passage of either the cylinder head or the crankcase. Such a check valve also ensures that the cam phaser does not empty out in cases when the oil pressure is reduced, for example when the engine is stopped. However, this approach adds significant cost to the cylinder head or engine block. Also, the implementation of the check valve can be difficult because of oil routing. Furthermore, the check valve should not be placed too far away from the cam phaser in order to be still effective.

The present invention relates to an improved control scheme for an oil control valve. The object of the invention is to provide a remedy for the defects of the prior art. It is an object of the present invention to overcome problems and drawbacks described above. The present invention specifically aims at addressing the problem of the reverse oil flow.

SUMMARY OF THE INVENTION

This is achieved by a method for operating an oil flow control valve in a combustion engine, wherein said oil flow control valve is provided for affecting a cam phaser, disposed at an output side of said oil flow control valve, and wherein said oil flow control valve comprises a spool disposed in a spool housing, is proposed, wherein the method comprises the step of synchronising a displacement of said spool in said housing with combustion demands, and wherein the method is characterised by further comprising the step of synchronising movement of said spool with oil pressure characteristics on the output side of the oil flow control valve.

The inventor has found that any reverse flow on account of the pressure ratio on the output side of the OCV and a corresponding input side could be prevented by synchronising the movement of the OCV spool with oil pressure characteristics on the output side of the OCV, where said synchronisation basically results in the spool being moved to a position where the OCV's oil ports are closed once the oil pressure on the output side of the OCV is too high for feeding oil to the cam phaser and in the spool being moved to a position where the oil ports are open once the oil pressure on the output side of the OCV allows for feeding oil to the cam phaser. The movement control as outlined above also or alternatively applies when retarding the cam phaser by releasing oil via the OCV.

An advantage of the invention is that the spool functions as a check valve. Accordingly, a check valve, which was introduced into an OCV according to recent approaches for preventing reverse flow, is no longer necessary. With the check valve having been made redundant, manufacture of the OCV is highly facilitated, resulting in cost reduction and improved maintenance conditions.

In accord with the present invention, a measure indicative of said oil pressure characteristics on the output side of the oil flow control valve, which preferably is provided by a sensor disposed on or associated with the cam shaft (cam shaft sensor), is accounted for when applying the control method. Relying on sensor data, indicating pressure conditions which could result in reverse flow, allows for reliable synchronisation of the spool movement and the relevant pressure conditions.

Preferably, the invention provides for a movement of the OCV spool, which involves an oscillation of the spool between a first and an intermediate location or a second location and said intermediate location of the spool, wherein said first location is provided for commanding the cam shaft to an advanced position and wherein said second location is provided for commanding the cam shaft to a retarded position. During oscillation the spool periodically opens and closes the oil ports in antiphase with the oil pressure characteristics on the output side of the OCV, i.e. the ports are blocked at high pressure and the ports are open at low pressure conditions.

Furthermore preferably, said oscillation is effected by means of synchronous energisation or de-energisation of a control unit provided for positioning the spool. More particularly, said energisation or de-energisation involves energisation or de-energisation of a coil disposed in the control unit. Displacement and movement of the spool is then induced by means relying on electromagnetic effects, which allows for almost instantaneous response to the relevant control signals since the oscillation, i.e. the movement of the spool, can be very fast.

In further accord with the present invention, synchronously displacing the spool with combustion demands and synchronously moving the spool with oil pressure characteristics is effected by overlaying a first energisation or de-energisation signal for said coil derived on account of said combustion demands and a second energisation or de-energisation signal for said coil derived on account of said pressure characteristics.

The invention also pertains to an apparatus for controlling the oil flow control valve in a combustion engine according to the above mentioned or subsequently described method steps. To this end the apparatus comprises means provided for and capable of performing these method steps, such as at least one sensor, more particularly the abovementioned cam shaft sensor, means for evaluating readings from said sensor, and means for affecting the OCV, more particularly the spool comprised in the OCV, on account of such evaluation.

The invention also pertains to an implementation of these method steps in software and to a storage medium comprising a software implementation of these method steps.

BRIEF DESCRIPTION OF THE DRAWINGS

Other features and advantages of the present invention will appear from the following description of a preferred embodiment of the invention, given as a non-limiting example, illustrated in the drawings. All the elements which are not required for the immediate understanding of the invention are omitted. In the drawings, the same elements are provided with the same reference numerals in the various figures, and in which.

DETAILED DESCRIPTION OF THE PREFERRED EMBODIMENT

In the following description, for purposes of explanation and not limitation, specific details are set forth, such as particular embodiments, data flows, signalling implementations, interfaces, techniques, etc. in order to provide a thorough understanding of the present invention. However, detailed descriptions of well-known methods, interfaces, devices, and signalling techniques are omitted so as not to obscure the description of the present invention with unnecessary detail. Moreover, individual function blocks are shown in some of the figures. Those skilled in the art will appreciate that the functions may be implemented using individual hardware circuits, using software functioning in conjunction with a suitably programmed digital microprocessor or general purpose computer, such as an application specific integrated circuit (ASIC).

Figure 1:
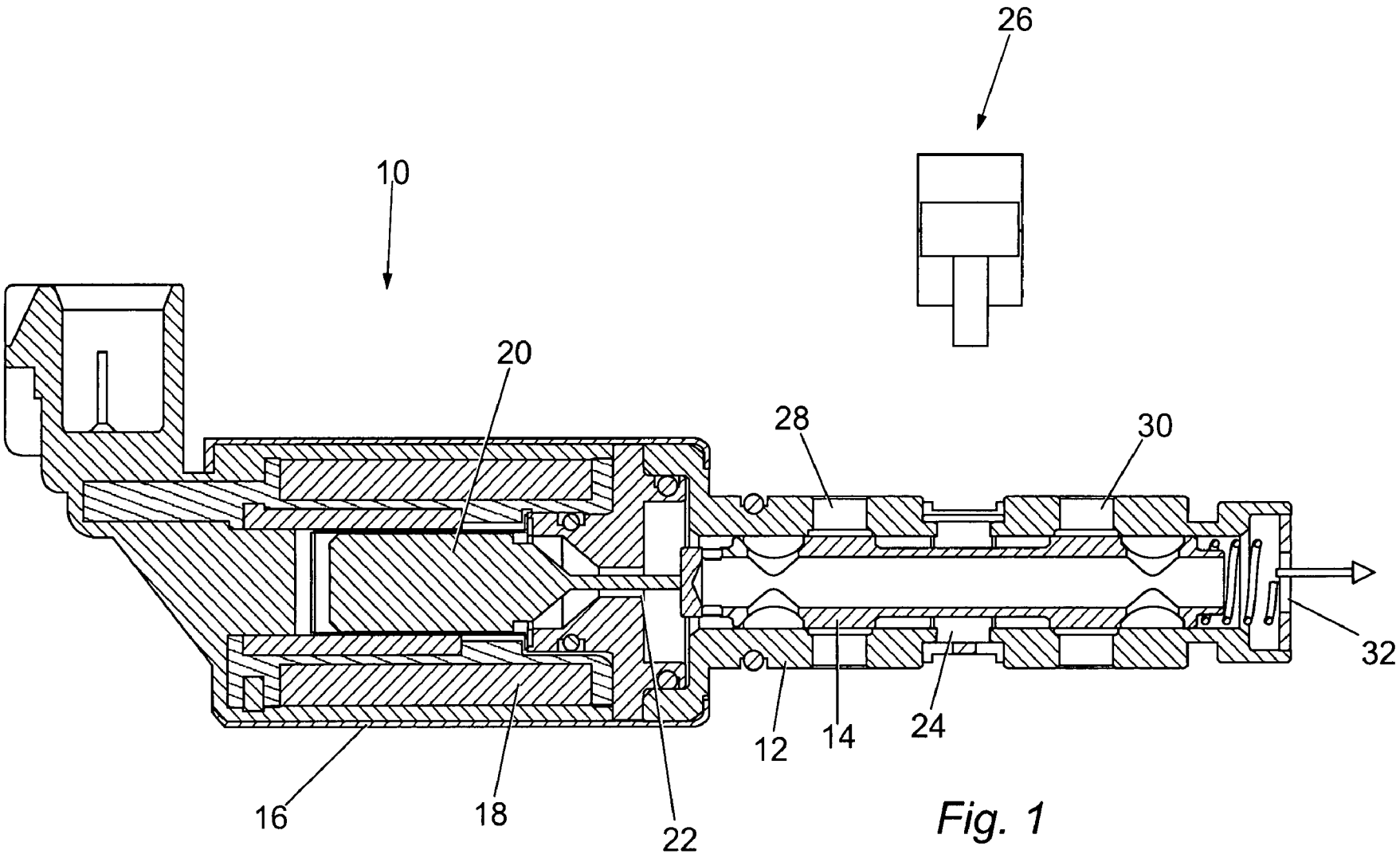
FIG. 1 is a sectional view of an oil flow control valve (OCV)

FIG. 1 shows a sectional view of an oil flow control valve (OCV) 10. The OCV 10 comprises a housing 12, a spool 14 located in the housing 12 and a control unit 16 for controlling the position of the spool 14 in the housing 12. The control unit 16 comprises a coil 18 which is provided for affecting a spool head (plunger) 20 which is combined with the spool 14 by means of a rod 22 extending in the housing 12. The OCV 10 is provided for controlling oil flow from an oil supply channel (not shown) via an oil supply port 24 into a cam phaser 26 (portrayed only in schematically simplified form) of an internal combustion engine (not shown). The OCV 10 is generally mounted in a bore in the engine cylinder head. The housing 12 of the OCV 10, which is formed like a sleeve, comprises as openings the abovementioned supply port 24 and furthermore a first and a second cam phaser port 28, 30 and a vent 32. The ports 24, 28, 30 cooperate with oil channels (not shown) arranged in the cylinder head. The oil flow through the OCV 10 and these channels is essentially controlled by the position of the spool 14 which is reciprocally mounted in the housing 12. A position of the spool 14 in the housing 12 is controlled by the control unit 16, which includes the coil 18 functioning as a solenoid actuator.

The basic functionality of the OCV 10, which is generally known in the art, is now briefly described in connection with FIG. 2, FIG. 3 and FIG. 4.

Figure 2:
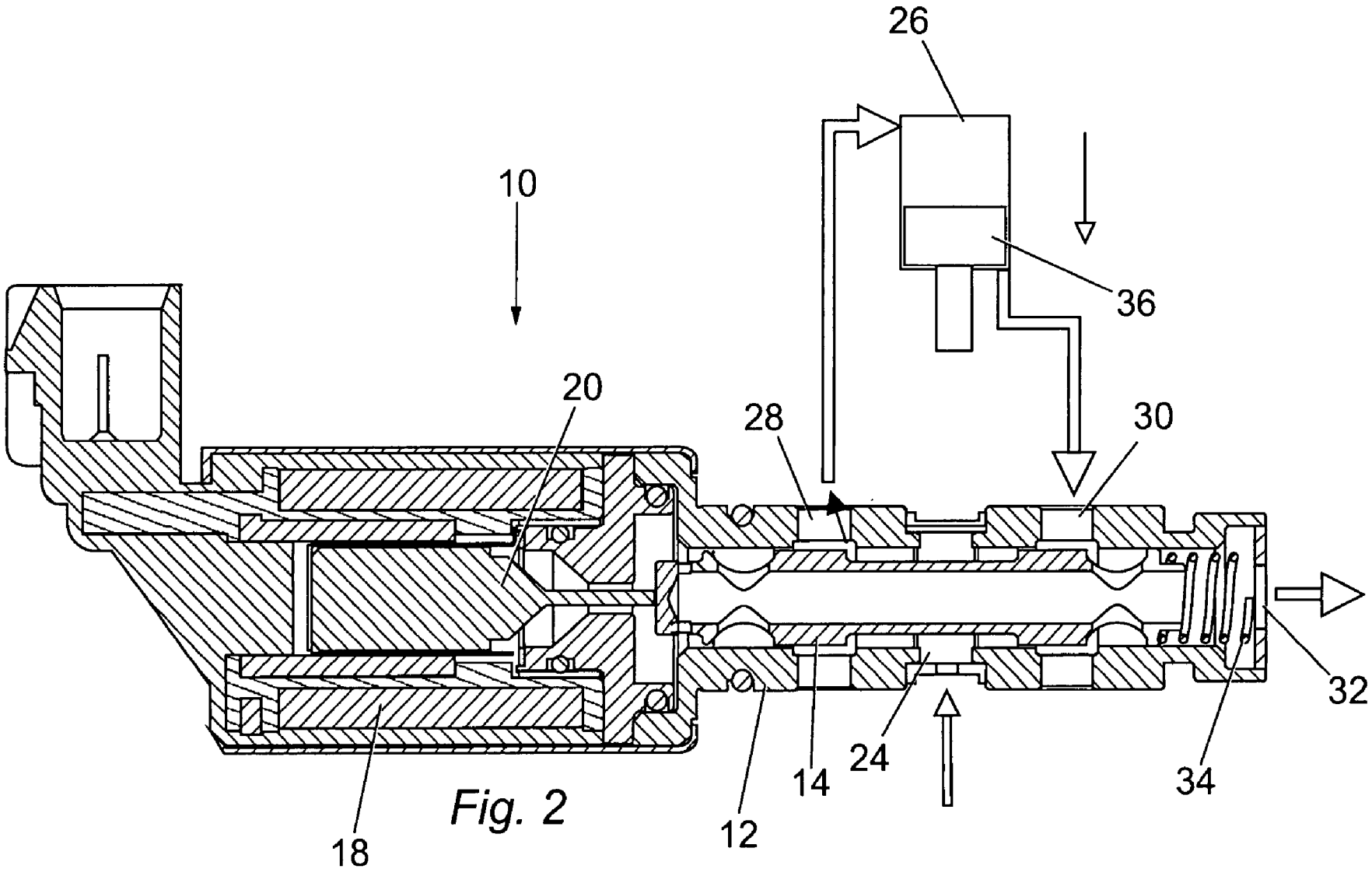
FIG. 2 is a sectional view of a de-energised OCV with a spool comprised in the OCV being shifted into a first position.

FIG. 2 shows a situation, where the OCV 10 is de-energised, i.e. where the coil 18 is de-energised, resulting in the spool 14 being shifted by means of a spring 34 into a first or uppermost position. In this position of the spool 14 all ports 24, 28, 30 are open, allowing supply oil to enter the spool housing 12 via the supply port 24 and being fed via the first cam phaser port 28 to the cam phaser 26. The oil received at the cam phaser 26 moves a piston 36 comprised in the cam phaser 26. Oil, which was contained in the cam phaser 26 prior to oil being fed via the first cam phaser port 28 to the cam phaser 26 is now thrust out of the cam phaser 26 and enters and leaves the spool housing 12 via the second cam phaser port 30 and the vent 32, respectively. The position of the spool 14 portrayed in FIG. 2 causes the cam phaser 26 to move "full stroke".

Figure 3:
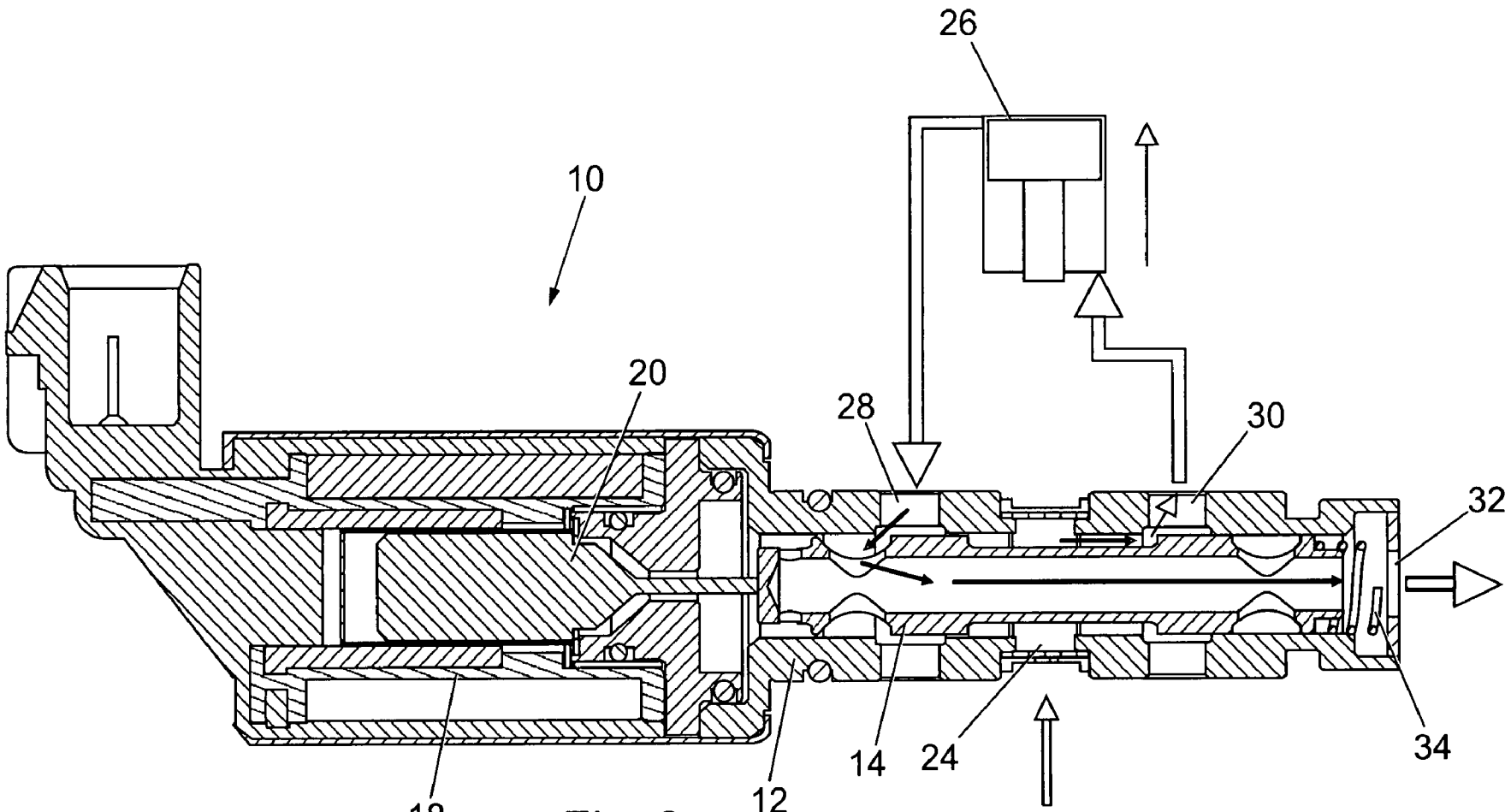
FIG. 3 is a sectional view of an energised OCV with a spool being shifted into a second position.
Figure 4:
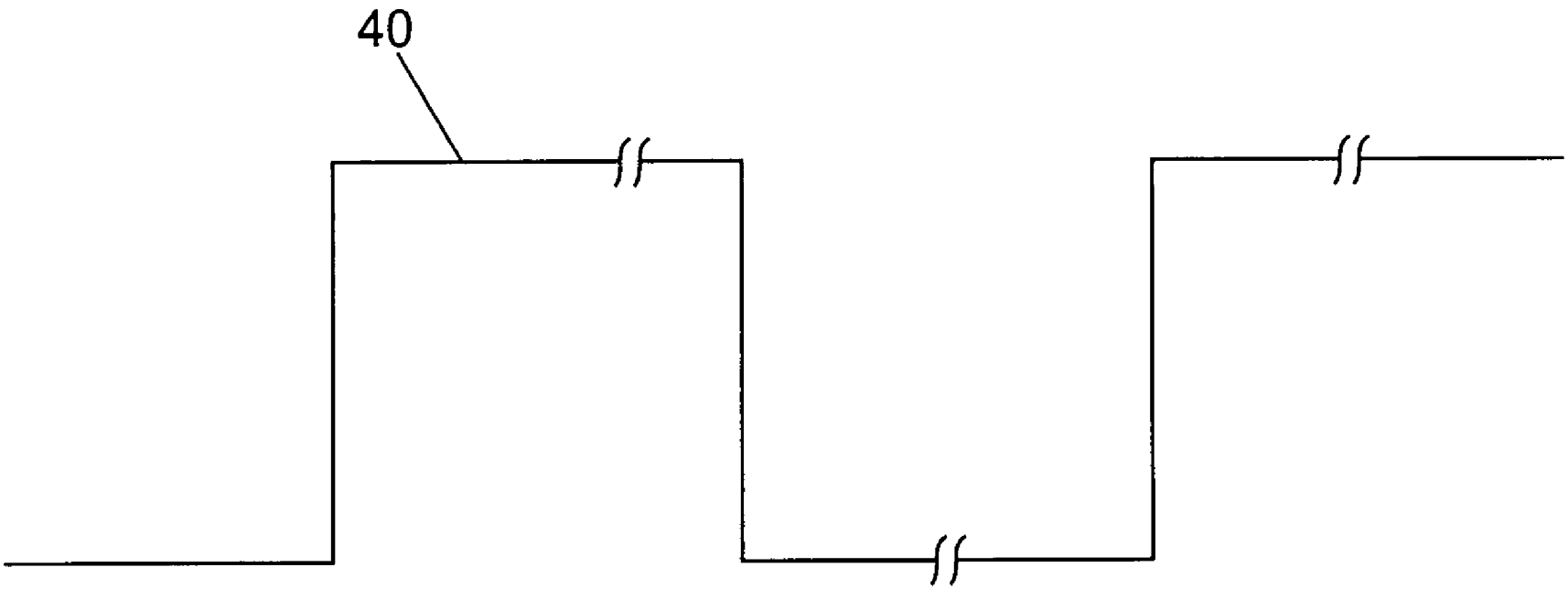
FIG. 4 is a schematical representation of a first energisation or de-energisation signal applied when shifting the spool into the first or second position

Turning now to FIG. 3, FIG. 3 shows a situation, where the OCV 10 is fully energised and where the spool 14 is, against the spring force of the spring 34 forced into a second or lowermost position by means of the solenoid actuator 18, 20, i.e. by means of energising the coil 18 comprised in the control unit 16. In the lowermost position of the spool 14 the supply port 24 is also open and thus allows fuel to enter the spool housing 12. However, contrary to the situation portrayed in FIG. 2, the lowermost position of the spool 14 now connects the supply port 24 with the second cam phaser port 30 and thus results in oil being fed to the cam phaser 26 in a way which causes the cam phaser 26 to "move full stroke opposite direction". Oil thrust out of the cam phaser 26 enters and leaves the spool housing 12 via the first cam phaser port 28 and the vent 32, respectively.

Normal operation of the OCV 10 as is so far known in the art would cause movement of the spool 14 between the above described first or uppermost position (FIG. 2), the second or lowermost position (FIG. 3) and an intermediate position (FIG. 5, infra) according to (synchronised with) what is throughout the application generally termed as combustion demands.

The invention now proposes to synchronise the displacement of the spool 14 in the housing 12 not only with combustion demands, but with oil pressure characteristics on the output side, i.e. extending from the first and second cam phaser port 28, 30 onwards, of the OCV 10 also. FIG. 4, to this end, shows a square wave signal 40 indicative of a current through the coil 18. At peak levels of the current through the coil 18 the valve 10 is energised and the spool 14 is displaced into the lowermost position (FIG. 3). Between the peak levels of the current the valve 10 is de-energised and the spool 14 is displaced into the uppermost position (FIG. 2). For moving the spool 14 into an intermediate position (FIG. 5, infra) an intermediate level of the current applied to the coil 18 applies respectively.

With the spool 14 being either in the uppermost or lowermost position one of the cam phaser ports 28, 30 is open for feeding oil to the cam phaser and one of the cam phaser ports 28, 30 is open for receiving oil from the cam phaser. However, even when feeding oil to the cam phaser 26, due to efforts in the valve train, a situation might occur, where the pressure in the respective reservoir of the cam phaser 26, which connects via the respective cam phaser port 28, 30 to the supply port 24, might exceed the supply oil pressure. An unbalance in pressure on the receiving side, i.e. in the respective reservoir of the cam phaser 26, and the supply side, i.e. the supply oil pressure, causes reverse flow which is detrimental. In order to overcome reverse flow, prior approaches have proposed to employ check valves. The invention, however, does not rely on check valves to prevent reverse flow. The invention rather proposes to utilise the spool 14 to prevent reverse flow, as will be described below in connection with FIG. 5.

Figure 5:
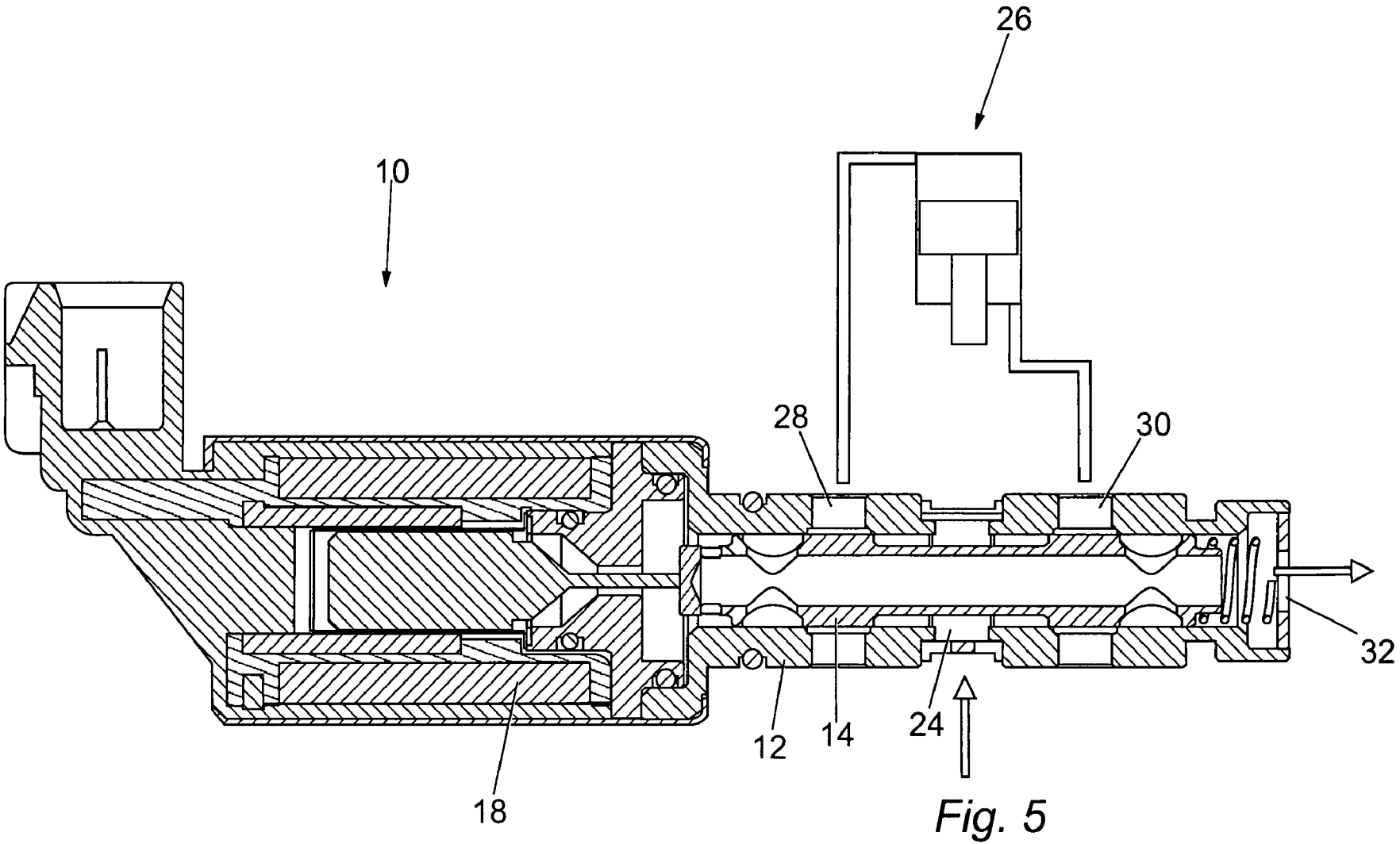
FIG. 5 is a sectional view of an OCV in an intermediate position.

FIG. 5 shows the OCV 10 in a partly energised situation, where partly energised refers to feeding, for example, 50% of the current through the coil 18, as opposed to the fully energised situation (FIG. 3) where 100% of the current would be fed through the coil 18 causing the spool 14 to be disposed into the lowermost position. Partly energising the coil 18 causes the spool 14 to be held in a fixed intermediate position, i.e. in a position between the uppermost and lowermost position. In the intermediate position all ports 24, 28, 30, i.e. the supply port 24 and the first and second cam phaser ports 28, 30, are blocked. With both the first and second cam phaser ports 28, 30 being blocked the vent 32 is blocked also. With all ports 24, 28, 30 blocked, no oil can enter the OCV 10 from either direction, i.e. supply oil cannot enter the OCV 10 on account of the blocked supply port 24, oil from the cam phaser 26 cannot enter the OCV on account of the blocked first and second cam phaser port 28, 30. All ports 24, 28, 30 being blocked results in the cam phaser 26 being held in an intermediate position also.

The invention now proposes to move the spool 14 to the intermediate position (FIG. 5) whenever this is required on account of oil pressure characteristics on the output of the OCV 10 in order to prevent reverse flow. Since reverse flow conditions basically result from efforts in the valve train, reverse flow conditions occur with a certain regularity. More specifically, it has been found that the oil pressure characteristics on the output side of the OCV 10 resembles at least for certain engines under certain conditions a sine curve with the peaks pertaining to a condition, where the oil pressure on the output side of the OCV 10 exceeds the supply oil pressure and wherein the troughs pertain to a condition where the oil pressure on the output side of the OCV is below the supply oil pressure.

When the piston 36 in the cam phaser 26 is to be commanded in an uppermost or lowermost full stroke position without allowing reverse flow to occur, the invention proposes to synchronise the movement of the spool with these oil pressure characteristics. A resulting current 42 applied when energising the coil 18 for opening the second cam phaser port 30 and thus displacing the spool generally in the lowermost position is in simplified manner portrayed in FIG. 6. Once reverse flow conditions occur due to oil pressure characteristics on the output side of the OCV 10, the current 42 through the coil 18 is immediately reduced to an intermediate value which causes the spool 14 to be displaced into the intermediate position (FIG. 5) at least for the duration of the reverse flow conditions. Once the reverse flow conditions have ceased, the coil 18 is again fully energised and the cam phaser 26 is further advanced. In effect, the oscillating characteristics of the current 42 for the coil portrayed in FIG. 6 results in the spool oscillating between the lower-most position (FIG. 3) and the intermediate position (FIG. 5). With the spool 14 being in the intermediate position on account of the oil pressure characteristics on the output side of the OCV, reverse flow is prevented. The above also applies, mutatis mutandis, for a de-energised OCV 10.

A measure indicative of said oil pressure characteristics on the output side of the OCV 10 is provided by a sensor (not shown) disposed on or associated with the cam shaft (not shown) of the respective combustion engine. A sensor which could be used for providing this measure indicative of the oil pressure characteristics could be the cam shaft sensor, which is well known in the art. Therefore, the cam shaft sensor and its position in relation to the relevant parts of the combustion engine is not specifically shown.

Synchronously displacing the spool 14 with combustion demands and synchronously moving (oscillating) the spool 14 with oil pressure characteristics on the output side of the OCV is effected by overlaying a first energisation or de-energisation signal 40 (FIG. 4) for the coil 18 derived on account of said combustion demands, more particularly derived on account of said combustion demands by means of a control programme implemented in a control unit, and a second energisation or de-energisation signal for the coil 18 derived on account of said pressure characteristics. The resulting overlay of both these energisation or de-energisation signals is the signal 42 shown in FIG. 6.

Figure 6:
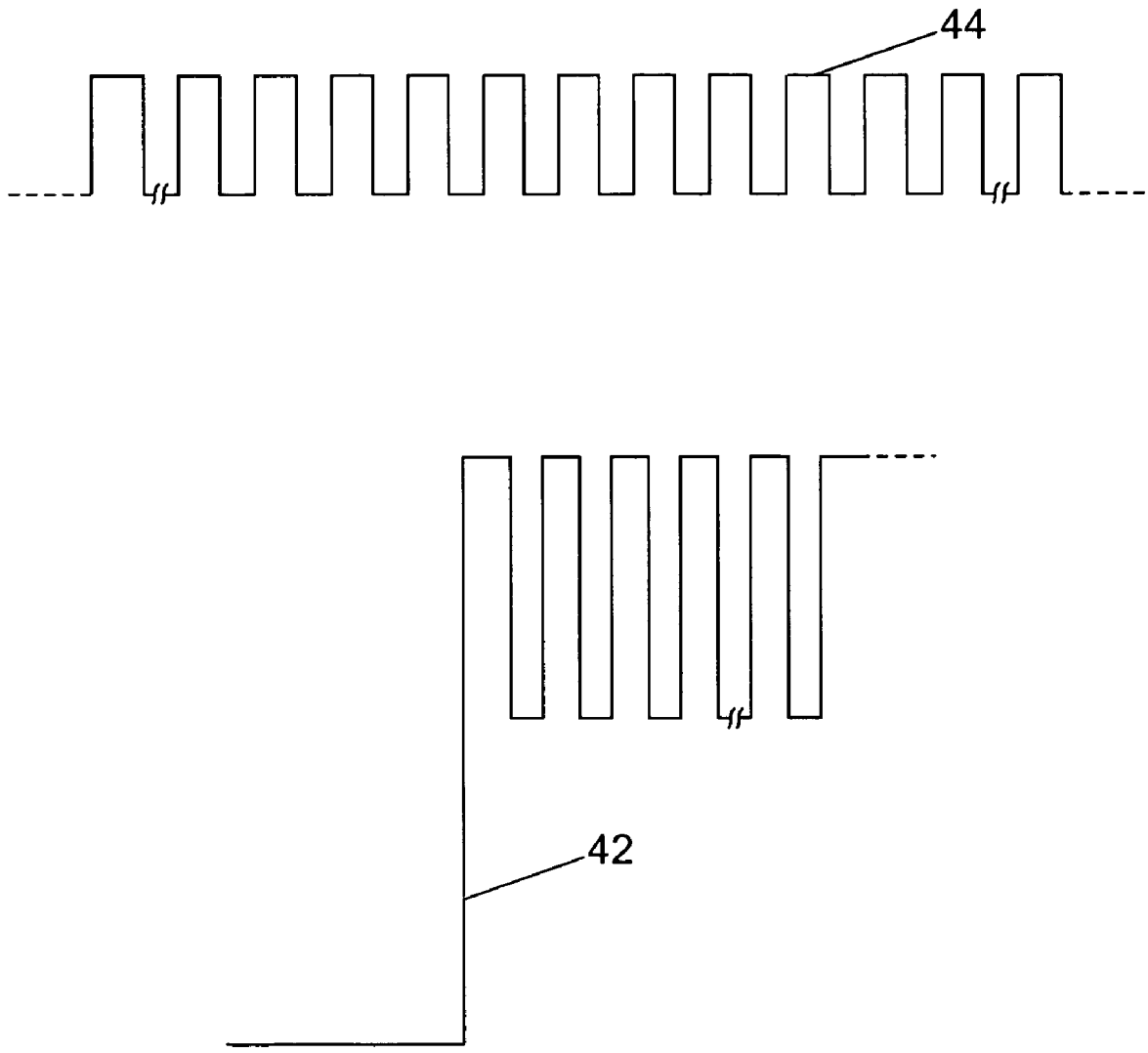
FIG. 6 is a schematical representation of an energisation or de-energisation signal resulting from synchronising the displacement of the spool both with combustion demands and with oil pressure characteristics on an output side of the OCV.

Signal 44 shown in FIG. 6 is meant to indicate a signal obtained from e.g. the cam shaft sensor or derived from such a cam shaft sensor signal. This signal repetitively indicates, e.g. a zero-crossing in the angular position of the cam shaft. With further data e.g. from the engine control unit an instance of time can be calculated or estimated when reverse flow condition can normally expected to occur. Data accounted for when calculating or estimating the occurrence of reverse flow conditions could be revolutions per minute, oil pressure, and/or oil temperature, etc. On this account there is a relation between e.g. a rising edge in the signal 44 and the necessity to command the spool 14 into the intermediate position and thus a relation, e.g. a phase shift, between the signal 44 and the oscillating portion of the signal 42. This relation is not necessarily fixed, since at low rpm the distance in time between e.g. the zero-crossing and the angular position at which reverse flow would normally occur, is smaller as opposed to high rpm conditions. The same applies when taking oil pressure and/or oil temperature or other relevant parameters into account. Preferably all relevant parameters are reflected in a set of characteristic curves (not shown) and a phase shift between signal 44 and the oscillation in signal 42 is varied on account of an application of said set of characteristic curves.

Although a preferred embodiment of the invention has been illustrated and described herein, it is recognized that changes and variations may be made without departing from the invention as set forth in the claims. More specifically, while the particular method and apparatus for operating an OCV as herein shown and described in detail is fully capable of attaining the above-described objects of the invention, it is to be understood that it is the presently preferred embodiment of the invention and thus is representative of the subject matter which is broadly contemplated by the present invention. However, the scope of the present invention fully encompasses other embodiments which may become obvious to those skilled in the art. Accordingly, the scope of the present invention is to be limited by nothing other than the appended claims, in which, for example, reference to an element in the singular is not intended to mean "one and only one" unless explicitly so stated, but rather "one or more". All structural and functional equivalents to the elements of the above-described preferred embodiment that are known, or later come to be known, to those of ordinary skill in the art are expressly incorporated herein by reference and are intended to be encompassed by the present claims. Moreover, it is not necessary for a device or method to address each and every problem sought to be solved by the present invention, in order to be regarded as being encompassed by the present claims.

The invention claimed is:

1. A method for operating an oil flow control valve in a combustion engine, said oil flow control valve having an input side for receiving a supply oil pressure from an oil supply, said oil flow control valve being provided for affecting a cam phaser disposed at an output side of said oil flow control valve and comprising a spool disposed in a spool housing with cam phaser ports for feeding oil to and from said cam phaser, the method comprising the step of synchronising a displacement of said spool in said housing with combustion demands, and synchronising movement of said spool with oil pressure characteristics on the output side of the oil flow control valve, wherein said oil pressure characteristics on the output side of the oil flow control valve that exceed said supply oil pressure cause movement of said spool to block said cam phaser ports, and wherein said oil pressure characteristics on the output side of the oil flow control valve that are below said supply oil pressure cause movement of said spool to open said cam phaser ports.

2. The method according to claim 1, wherein a measure indicative of said oil pressure characteristics on the output side of the oil flow control valve is provided by a cam shaft sensor disposed on or associated with the cam shaft.

3. The method according to claim 1, wherein said movement of the spool involves an oscillation of the spool around a first location of the spool provided for commanding the cam shaft in an advanced position or a second location of the spool provided for commanding the cam shaft in a retarded position.

4. The method of claim 3, wherein said oscillation is effected by means of synchronous energisation or de-energisation of a control unit provided for positioning the spool.

5. The method of claim 4, wherein energisation or de-energisation of said control unit involves energisation or de-energisation of a coil disposed in the control unit.

6. The method of claim 5, wherein synchronously displacing the spool with combustion demands and synchronously moving the spool with oil pressure characteristics is effected by overlaying a first energisation or de-energisation signal for said coil derived on account of said combustion demands and a second energisation or de-energisation signal for said coil derived on account of said pressure characteristics.

* * * * *